US007830326B2

(12) United States Patent
Hung et al.

(10) Patent No.: US 7,830,326 B2
(45) Date of Patent: Nov. 9, 2010

(54) MULTI-BAND ANTENNA

(75) Inventors: Chen-Ta Hung, Tu-cheng (TW); Shu-Yean Wang, Tu-cheng (TW); Yao-Shien Huang, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/151,438

(22) Filed: May 7, 2008

(65) Prior Publication Data

US 2008/0278382 A1 Nov. 13, 2008

(30) Foreign Application Priority Data

May 7, 2007 (TW) ..... 96116050 A

(51) Int. Cl.
*H01Q 21/00* (2006.01)

(52) U.S. Cl. ..... 343/826; 343/830

(58) Field of Classification Search ..... 343/700 MS, 343/702, 795, 826, 828–830, 846
See application file for complete search history.

(56) References Cited

U.S. PATENT DOCUMENTS 6,759,988 B2 * 7/2004 Purr et al. ..... 343/700 MS
6,861,986 B2 3/2005 Fang
7,242,352 B2 * 7/2007 Tavassoli Hozouri . 343/700 MS
2005/0190108 A1 9/2005 Lin
2006/0250309 A1 11/2006 Fang

FOREIGN PATENT DOCUMENTS

TW 563274 11/2003

* cited by examiner

*Primary Examiner*—Michael C Wimer
(74) *Attorney, Agent, or Firm*—Wei Te Chung; Andrew C. Cheng; Ming Chieh Chang

(57) ABSTRACT

Provided herewith a multi-band antenna comprising a grounding element lying in a first plane and comprising two longitudinal sides, a radiating element spaced apart from the grounding element and comprising a first radiating arm having a first length and a second radiating arm having a second length being about equal to the first length, a connecting element lying in a second plane and electrically connecting the grounding element and the radiating element; a feeding line comprising an inner conductor for feeding signal and an outer conductor electrically connecting to the grounding element; and a coupling radiating element extending vertically from the grounding element and comprising a first radiating portion lying in a third plane and a second radiating portion being perpendicular to the third plane.

20 Claims, 3 Drawing Sheets

MULTI-BAND ANTENNA

CROSS-REFERENCE TO RELATED APPLICATION

This application relates to the copending application entitled "ULTRA WIDEBAND ANTENNA", which has the same assignee with the present invention.

FIELD OF THE INVENTION

The present invention relates to an antenna, and more particularly to an multi-band antenna having more wider frequency band for a portable electronic device.

DESCRIPTION OF PRIOR ART

Wireless communication devices, such as cellular phones, notebook computers, electronic appliances, and the like, are normally equipped with an antenna that serves as a medium for transmission and reception of electromagnetic signals. The antenna can be built outside or inside the devices. The antenna is generally built-in the device, with a portion exposed and extended outwardly or completely hidden inside. However, the latter (built-in type) are more attractive practical due to the tendency of being folded and broken associated with former upon use.

In recent years, more and more people industry pay attention to and use the technology of Ultra Wideband (UWB). UWB has many advantages, such as wider ranges of frequency, good anti-interference capability, and low power consumption. Accordingly, UWB and Bluetooth have become two key technologies of WPAN (Wireless Personal Area Network) for using now and in near future.

Taiwanese Patent No. 563274 discloses an inverted-F antenna working in 2.4 GHz, and 5 GHz. However, the high frequency band of the antenna is so narrow that dissatisfy UWB.

Hence, in this art, an antenna to overcome the above-mentioned disadvantages of the prior art will be described in detail in the following embodiment.

SUMMARY OF THE INVENTION

An object of the present invention is to provide a multi-band antenna which has more wider range frequency band.

To achieve the aforementioned object, the present invention provides a multi-band antenna comprising a grounding element lying in a first plane and comprising two longitudinal sides; a radiating element spaced apart from the grounding element and comprising a first radiating arm having a first length and a second radiating arm having a second length being about equal to the first length; a connecting element lying in a second plane and electrically connecting the grounding element and the radiating element; a feeding line comprising an inner conductor for feeding signal and an outer conductor electrically connecting to the grounding element; and a coupling radiating element extending vertically from the grounding element and comprising a first radiating portion lying in a third plane and a second radiating portion being perpendicular to the third plane.

Additional novel features and advantages of the present invention will become apparent by reference to the following detailed description when taken in conjunction with the accompanying drawings.

DETAILED DESCRIPTION OF PREFERRED EMBODIMENTS

Figure 1:
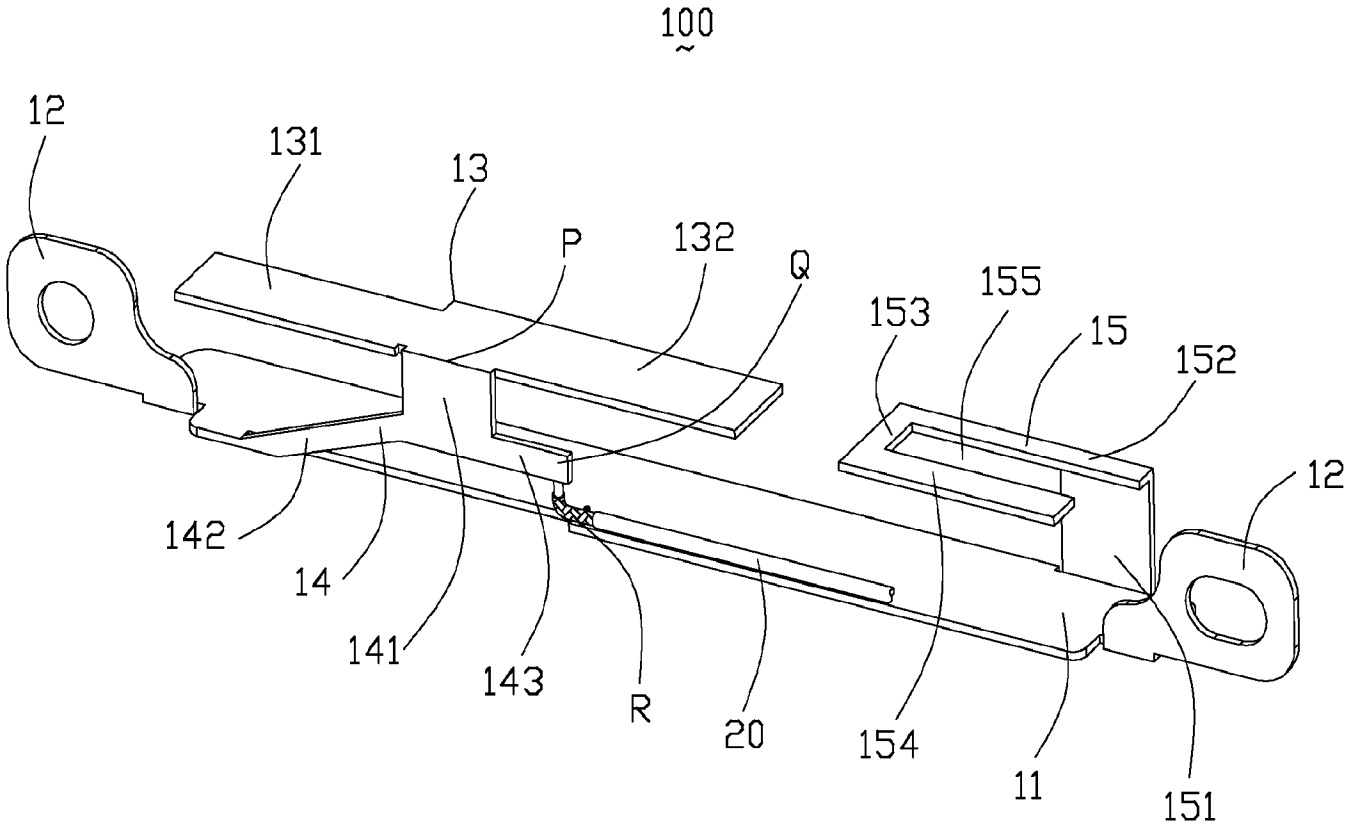
FIG. 1 is a perspective view of a multi-band antenna in accordance with a first embodiment of the present invention.
Figure 2:
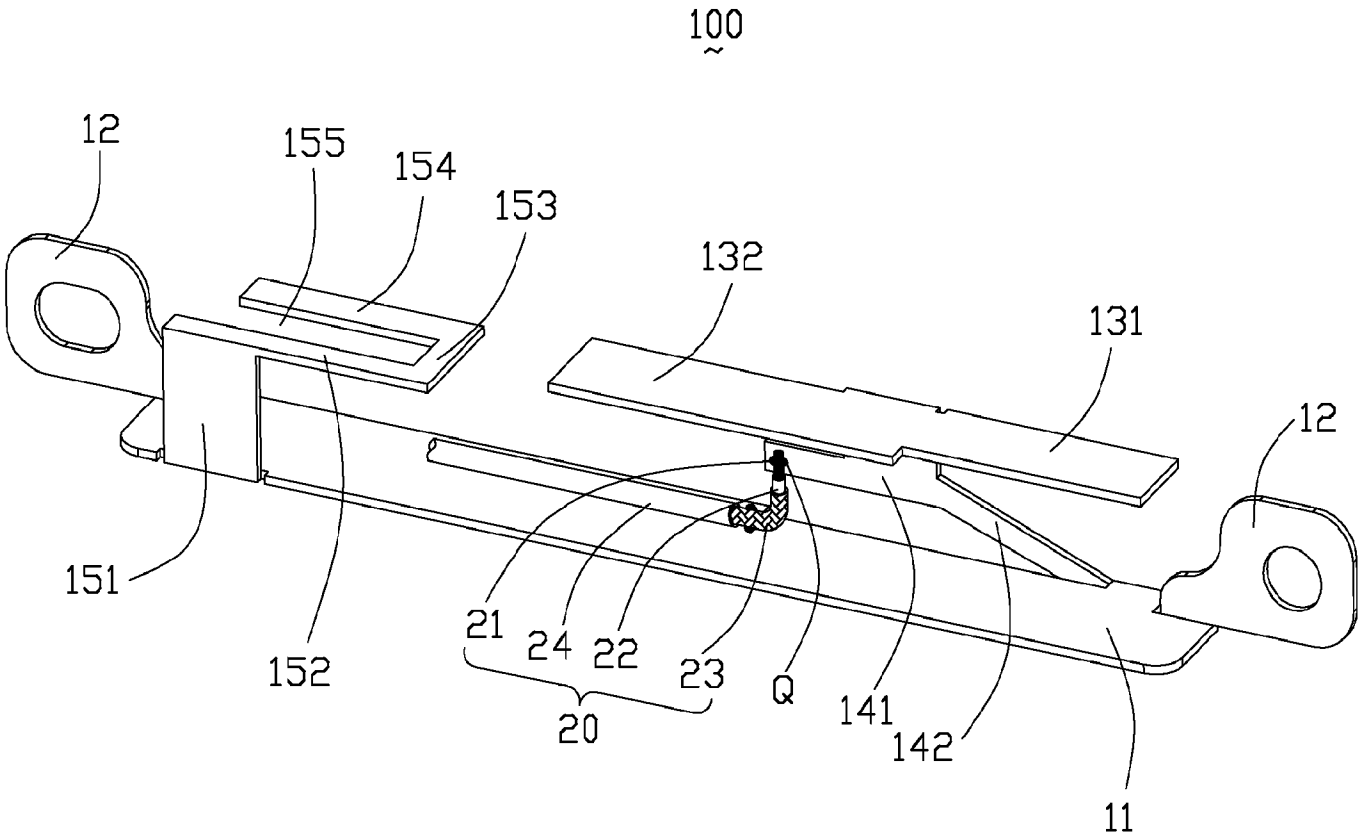
FIG. 2 is a view similar to FIG. 1, but from a different aspect.

Referring to FIGS. 1 and 2, an multi-band antenna 100 made in accordance with the present invention includes a grounding element 11 lying in a first horizontal plane and having two longitudinal sides, two installing elements 12 locating respectively at two ends of the grounding element 11, a radiating element 13 spaced apart from the grounding element 11, a connecting element 14 connecting the grounding element 11 and the radiating element 13, and a coupling radiating element 15. All of the installing elements 12, the radiating element 13, the connecting element 14, and the coupling radiating element 15 locate at a same side of the horizontal plane. A feeding line 20 comprises an inner conductor 21, an inner insulating layer 22, an outer conductor 23, and an outer insulating layer 24.

The connecting element 14 lying in a second plane being perpendicular to the first horizontal plane extends upwards and aslant from the first side of the grounding element 11 being close to the installing element 12. The connecting element 14 comprises a first arm 141 connecting to the radiating element 13 at a connecting point P, a second arm 142 extending upwards and aslant and connecting the first arm 141 and the grounding element 11, and a third arm 143 extending from a side of the first arm 141 opposite to the second arm 142. The third arm 143 has a terminal end forming a feeding point Q for electrically connecting to the inner conductor 21 of the feeding line 20. The radiating element 13 parallels to the grounding element 11 and comprises a first radiating arm 131 extending to a first direction and a second radiating arm 132 extending to a second direction opposite to the first direction. The first radiating arm 131 connects to the second radiating arm 132 at the connecting point P.

The coupling radiating element 15 extends upwards from the second side of the grounding element 11 being close to another installing element 12. The coupling radiating element 15 comprises a first portion lying a third plane being perpendicular to the first horizontal plane and extending vertically and upwards from the second side of the grounding element 11 and a second portion extending from an end of the first portion and paralleling to the grounding element 11. The first radiating portion comprises a third radiating arm 151. The second radiating portion is inverted "n" shape and comprises a fourth radiating arm 152, a fifth radiating arm 153 extending vertically from the fourth radiating arm 152, and a sixth radiating arm 154 extending vertically from the fifth radiating arm 153. The fourth radiating arm 152, the fifth radiating arm 153, and the sixth radiating arm 154 formed a slot 155. The second plane parallels to the third plane.

The grounding element 11 has a grounding point R for electrically connecting to the outer conductor 23 of the feeding line 20. The two installing elements 12 respectively locate at two longitudinal ends of the grounding element 11. Each installing element 12 has a installing hole for installing the multi-band antenna 100 onto the notebook or other electronic devices.

The radiating element 13 has two radiating arm. The first radiating arm 131 has a first length and the second radiating arm 132 has a second length being about equal to the first length. The first radiating arm 131 works in a first frequency band and the second radiating arm 132 works in a second frequency band connecting to the first frequency band. So, the radiating element 13 has an ultra wide frequency band ranging from 3.15 to 4.80 GHz.

Figure 3:
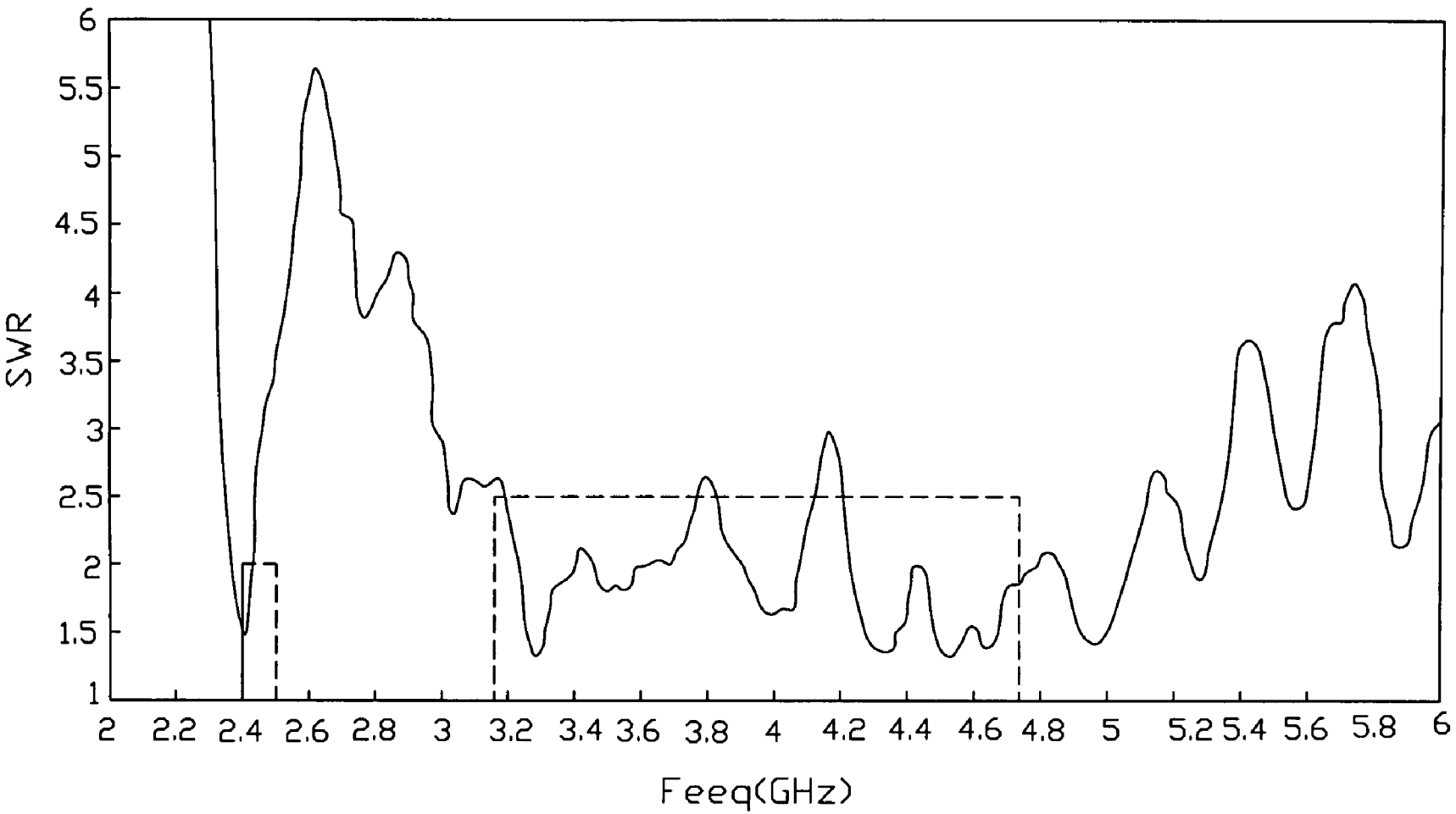
FIG. 3 is a test chart recording for the multi-band antenna of FIG. 1, showing Voltage Standing Wave Radio (VSWR).

FIG. 3 is a test chart of Voltage Standing Wave Ratio (VSWR) of the multi-band antenna 100. Generally speaking, VSWR under 2 dB is considered having good receiving quality. Under the definition of the VSWR less than 2 dB, it can be clearly seen from FIG. 3 that the values of the VSWR from 3.15 GHz to 4.80 GHz can satisfy the definition as well as the values of the VSWR from 2.4 GHz to 2.5 GHz so that the efficiency for receiving the frequencies is excellent.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. A multi-band antenna, comprising:

a grounding element lying in a first plane and comprising two longitudinal sides;

a radiating element spaced apart from the grounding element and comprising a first radiating arm having a first length and a second radiating arm having a second length being about substantially equal to the first length;

a connecting element lying in a second plane and electrically connecting the grounding element and the radiating element;

a feeding line comprising an inner conductor for feeding a signal and an outer conductor electrically connecting to the grounding element; and a coupling radiating element extending vertically from the second side of the ground element and comprising a first radiating portion lying in a third plane and a second radiating portion being perpendicular to the third plane.

2. The multi-band antenna as recited in claim 1, wherein the connecting element extends from a first longitudinal side of the grounding element.

3. The multi-band antenna as recited in claim 1, wherein the connecting element comprises a first arm connecting to the radiating element and a second arm extending upwards and aslant from the grounding element and connecting the grounding element and the first arm.

4. The multi-band antenna as recited in claim 3, wherein the connecting element also comprises a third arm extending from a bottom of the first arm of the connecting element lying a horizontal direction being away form the second arm of the connecting element.

5. The multi-band antenna as recited in claim 3, wherein the first radiating arm, the radiating arm, and the first arm connect to a joint point.

6. The multi-band antenna as recited in claim 1, wherein the first radiating portion extends from second longitudinal side and the second radiating portion extending from an end of the first radiating portion.

7. The multi-band antenna as recited in claim 6, wherein the second radiating portion parallels to the grounding element and comprising a fourth radiating arm, a sixth radiating arm spaced apart from the fourth radiating arm, and a fifth radiating arm connecting the fourth radiating arm and the sixth radiating arm.

8. The multi-band antenna as recited in claim 7, wherein the second radiating portion is an inverted "n" shape.

9. The multi-band antenna as recited in claim 1, wherein the radiating element is perpendicular to the first plane.

10. The multi-band antenna as recited in claim 1, wherein the multi-band antenna also comprises an installing element extending from an end of longitudinal direction of the grounding element.

11. The multi-band antenna as recited in claim 1, wherein the radiating element operates in a higher frequency band which is 3.15-4.80GHz; the coupling radiating element operates in a lower frequency band which is 2.4-2.5GHz.

12. The multi-band antenna as recited in claim 6, wherein the second radiating portion parallels to the grounding element and comprising a fourth radiating arm, a sixth radiating arm spaced apart from the fourth radiating arm, and a fifth radiating arm connecting the fourth radiating arm and the sixth radiating arm.

13. The multi-band antenna as recited in claim 1, wherein the radiating element operates in a higher frequency band which is 3.15-4.80GHz; the coupling radiating element operating in a lower frequency band which is 2.4-2.5GHz.

14. A multi-band antenna, comprising:

a grounding element lying in a first plane and comprising two longitudinal sides;

a radiating element spaced apart from the grounding element and comprising a first radiating arm and a second radiating arm;

a connecting element lying in a second plane and electrically connecting the grounding element and the radiating element;

a coupling radiating element extending vertically from the grounding element and comprising a first radiating portion lying in a third plane and a second radiating portion being perpendicular to the third plane; and the second plane and the third plane paralleling to each other and being perpendicular to the first plane.

15. The multi-band antenna as recited in claim 14, wherein the first radiating arm has a first length and the second radiating arm having a second length being about equal to the first length.

16. The multi-band antenna as recited in claim 14, wherein the multi-band also comprises a feeding line comprising an inner conductor for feeding signal and an outer conductor electrically connecting to the grounding element.

17. The multi-band antenna as recited in claim 14, wherein the connecting element extends from a longitudinal side of the grounding element and the coupling radiating element extending from another longitudinal side of the grounding element.

18. The multi-band antenna as recited in claim 14, wherein the connecting element comprises a first arm connecting to the radiating element, a second arm extending upwards and aslant from the grounding element and connecting the grounding element and the first arm, and a third arm extending from a bottom of the first arm of the connecting element lying a horizontal direction being away form the second arm of the connecting element.

19. A multi-band antenna comprising:

a grounding element;

a radiating element vertically spaced from and mechanically and electrically connected to the grounding element via a connecting element;

a feed cable mechanically and electrically connected to the connecting element; and a coupling element extending from the grounding element and horizontally spaced from both said radiating element and said connecting element; wherein said coupling element includes more than one radiating arms arm spaced from the grounding element and commonly located in a same plane with a height from the grounding element similar to that of the radiating element from the grounding element.

20. The antenna as claimed in claim 19, wherein the connecting element extends from a first side edge of the grounding element while said coupling element extends from a second side edge of the grounding element opposite to said first side edge.

* * * * *